United States Patent [19]

Miller

[11] Patent Number: 4,920,241

[45] **Date of Patent: * Apr. 24, 1990**

[54] HIGH SENSITIVITY DOOR EDGE SWITCH

[75] Inventor: Norman K. Miller, Concordville, Pa.

[73] Assignee: Miller Edge, Inc., Concordville, Pa.

[ * ] Notice: The portion of the term of this patent subsequent to Apr. 28, 2004 has been disclaimed.

[21] Appl. No.: 342,642

[22] Filed: Apr. 24, 1989

Related U.S. Application Data

[63] Continuation of Ser. No. 40,607, Apr. 21, 1987, abandoned, which is a continuation-in-part of Ser. No. 812,075, Dec. 23, 1985, Pat. No. 4,661,664.

[51] Int. Cl.[5] ..... H01H 3/16

[52] U.S. Cl. ..... 200/86 R; 200/61.43; 200/85 A; 340/666

[58] Field of Search ..... 340/665, 666; 307/119; 200/61.43, 85 R, 85 A, 86 R, 86 A, 86.5, 512, 5 A, 292, 302.1, 303, 61.58 R, 61.62, 61.71, 61.73

[56] References Cited

U.S. PATENT DOCUMENTS

| | | | |
|---|---|---|---|
| 3,133,167 | 5/1964 | Miller | 200/61.43 |
| 3,243,540 | 3/1966 | Miller | 200/86 R |
| 3,315,050 | 4/1967 | Miller | 200/61.43 |
| 3,462,885 | 8/1969 | Miller | 200/61.43 |
| 3,654,407 | 4/1972 | Kepner | 200/86 R |
| 3,754,176 | 8/1973 | Miller | 200/61.43 |
| 4,090,045 | 5/1978 | Marsh | 200/86 R |
| 4,137,116 | 1/1979 | Miller | 200/86 R |
| 4,200,777 | 4/1980 | Miller | 200/86 R |
| 4,349,710 | 9/1982 | Miller | 200/61.43 |
| 4,362,911 | 12/1982 | Sears | 200/86 R |
| 4,396,814 | 8/1983 | Miller | 200/61.43 |
| 4,661,664 | 4/1987 | Miller | 200/86 R |

*Primary Examiner*—Gerald P. Tolin

*Attorney, Agent, or Firm*—Panitch Schwarze Jacobs & Nadel

[57] ABSTRACT

A high sensitivity door edge switch including an openwork or perforate spacer for extension along a door edge, flexible conductors on opposite sides of the spacer in spaced apart confronting relation through the spacer perforations, and a resiliently compressible deflection element in facing relation with the spacer, the deflection element being elastically deformable into the spacer perforations to flex the conductive elements into engagement with each other upon low unit pressure applied to the deflection element, even over a large extent.

12 Claims, 3 Drawing Sheets

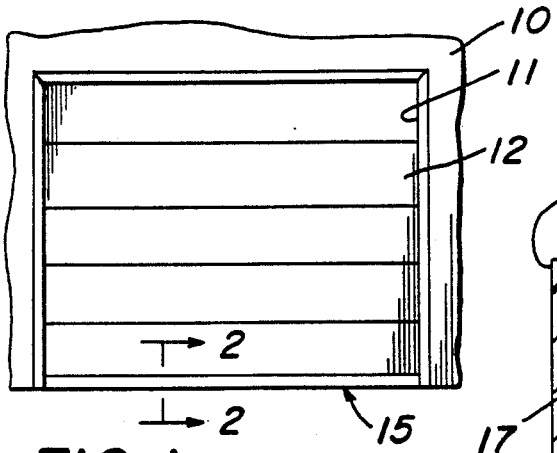
FIG. 1
FIG. 2
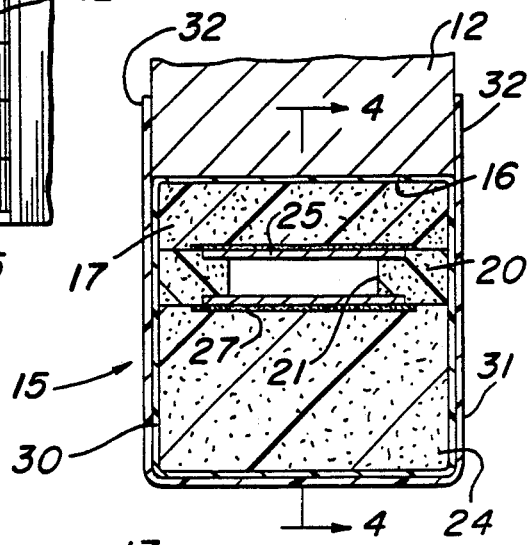
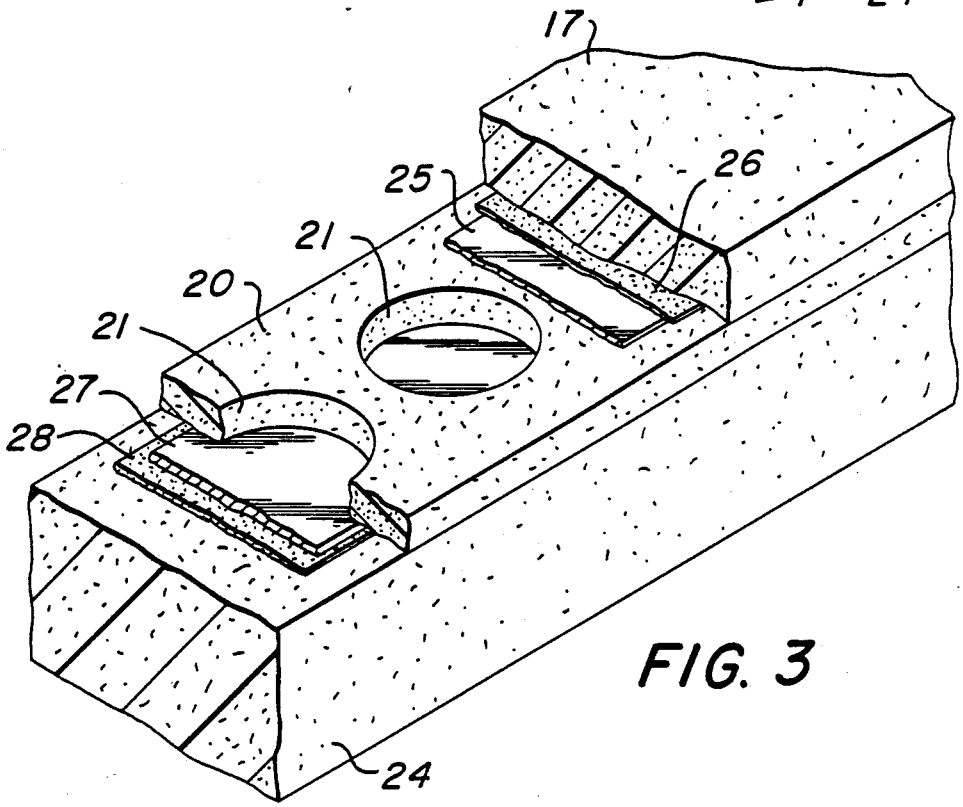
FIG. 3

HIGH SENSITIVITY DOOR EDGE SWITCH

CROSS-REFERENCES TO RELATED APPLICATIONS

This application is a continuation of U.S. patent application Ser. No. 040,607, filed Apr. 21, 1987, now abandoned; which is a Continuation-in-Part of my copending patent application Ser. No. 812,075, now U.S. Pat. No. 4,661,664, filed Dec. 23, 1985 and entitled HIGH SENSITIVITY MAT SWITCH.

BACKGROUND OF THE INVENTION

The high sensitivity door edge switch of the present invention is particularly concerned with safety edges and automatic stop switches for doors, such as overhead doors, public conveyance doors, wherein the door is automatically operated and it is desired to quickly, safely and reliably stop (and reverse, if required) door operation responsive to relatively low external pressure applied to the leading door edge, even if the external pressure is dispersed to effectively reduce its unit value. Of course, the instant door edge switch is capable of many varied applications, all of which are intended to be comprehended herein.

Illustrative of the prior art of which applicant is aware are the below listed patents:

| U.S. Pat. No. | Patentee |
|---|---|
| 3,243,540 | Miller |
| 3,462,885 | Miller |
| 3,754,176 | Miller |
| 4,090,045 | Marsh |
| 4,137,116 | Miller |
| 4,200,777 | Miller |
| 4,349,710 | Miller |
| 4,362,911 | Sears |
| 4,396,814 | Miller |

In prior art switches of this general type, there was required a highly localized deflection to operate the switch. Even a substantial force or weight may not have been sufficient to actuate a prior art switch, if the force or weight was distributed over a substantial area. In an attempt to obviate this problem, prior art devices often included internal protrusions for locally enhancing internal forces reacting to an external weight. This structure added to cost of materials, complexity of manufacture, and often inhibited or reduced flexibility to require additional space in shipping and storage.

SUMMARY OF THE INVENTION

It is among the important objects of the present invention to provide an electric door edge switch which overcomes the above mentioned difficulties, being highly sensitive to force or pressure imparted to the switch, being responsive to broadly applied forces rather than requiring highly localized forces, and which permits of fabrication from substantially flat material for economy in manufacture, flexibility in installation, and compactness in storage and shipment.

It is a further object of the present invention to provide a door edge switch which is of relatively high sensitivity so as to permit of relatively stiff external materials for enhanced wear resistance without detracting from switch sensitivity.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a front elevational view showing an overhead door having an edge switch in accordance with the teaching of the present invention.

FIG. 2 is a transverse sectional view taken generally along the line 2—2 of FIG. 1.

FIG. 3 is an enlarged, broken away view showing elements of the door edge of FIG. 2.

DESCRIPTION OF THE PREFERRED EMBODIMENT

Figure 4:
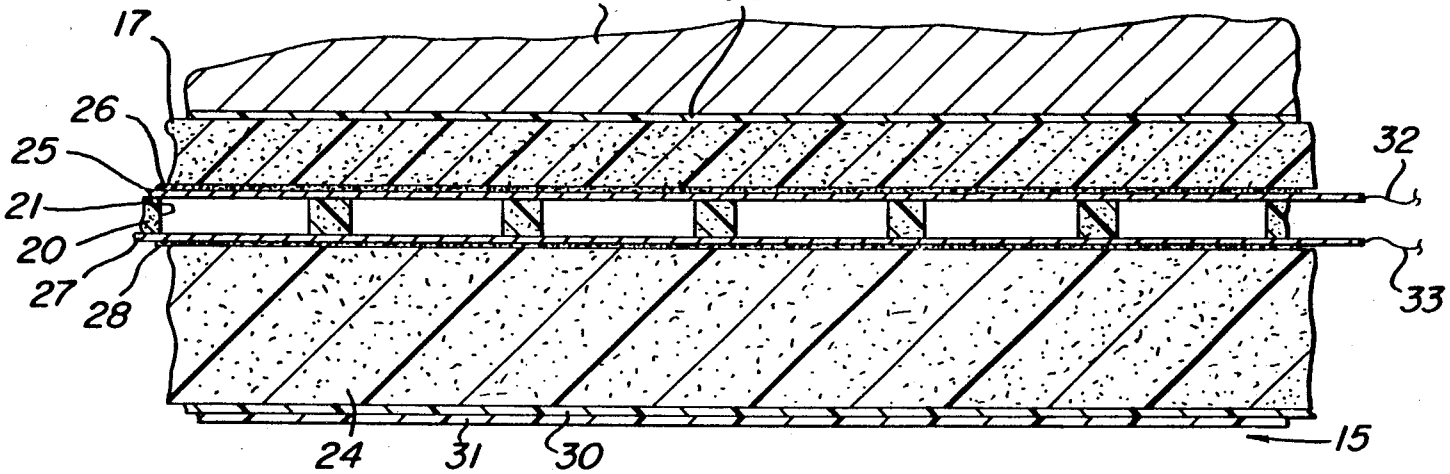
FIG. 4 is a longitudinal sectional view taken generally along the line 4—4 of FIG. 2 with the door edge switch in a distended or at rest condition.

Referring now more particularly to the drawings, and specifically to FIG. 1 thereof, a building wall is there designated 10, having formed therein a door opening or way 11. A door 12 is shown in the doorway 11 closing the same. The door 12 may be of the vertically moving or overhead type having along its lower or leading edge a high sensitivity door edge switch of the present invention generally designated 15. Of course, the door 12 may be of other types, for example a horizontally moving door, as in an elevator, bus or the like, having a vertical leading or closing edge provided with a switch of the present invention.

In FIG. 2 is shown the door 12, provided along its lower edge 16 with the door edge switch 15 of the invention. The internal construction of the door edge switch 15 is best seen in FIG. 3, as including an elongate inner element 17, such as a strip of foam extending closely along and in facing relation with the leading door edge 16. As illustrated the strip or inner element 17 may be of a width approximately laterally coextensive with the thickness of door 12; and while the inner element 17 may be fabricated of plastic foam, or the like, it may be relatively dense so as to be characterized by relative hardness or of relatively low elastic compressibility, as will appear more fully hereinafter.

The inner element 17 may be substantially longitudinally coextensive with the door edge 16, or of less extent if conditions require.

Immediately below and in facing relation with the inner element 17 is an intermediate spacer element or strip 20 which may be substantially coextensive in width and length with the inner element 17, and substantially congruent therewith. The intermediate element or spacer 20 is of an open work or perforated configuration, having a series of through holes or perforations 21. The spacer strip 20 may also be fabricated of plastic foam, and may be of a hardness equal to or less than that of the inner element 17, as by being of a density equal to or less than that of the inner element. In practice, the spacer 20 is advantageously of at least some resilient compressibility, while the inner element 17 is not necessarily resiliently compressible.

Immediately beneath the spacer 20, and substantially congruent therewith, is an outer elongate strip or deflection element 24, also advantageously fabricated of plastic foam. The outer or deflection element 24 is similarly of width and length so as to be horizontally coextensive with the outline configuration of spacer 20 and inner element 17.

The outer or deflection element 24 is relatively less dense that the spacer 20 so as to be relatively highly elastically compressible, having an elastic compressibility of at least 1.5 times that of the spacer 20. As will appear more fully hereinafter, the resilient compressibility of the deflection element 24 is sufficiently greater than that of the spacer 20 for resilient protrusion of the deflection element through the perforations 21 of the spacer under vertical compression of the assembly between horizontal planes.

Interposed in sandwiched relation between the inner element 17 and the spacer 20 is a highly flexibly compliant electrically conductive element 25, say aluminum foil or equivalent which may be carried by a backing sheet 26 of highly flexible compliant material, such as plastic sheeting or film. The conductive element 25 overlies the several apertures 21, facing downwardly therethrough.

A similar highly flexible and compliant element 27 is carried by a highly flexible backing sheet 28, which are together sandwiched in interposed relation between the spacer 20 and upper side of the outer or deflection element 24, with the conductive element 27 uppermost and facing upwardly through apertures 21. Thus, the conductive elements 25 and 27 are on opposite sides of the spacer 20 in spaced confronting relation through the perforations 21 in the condition shown in FIGS. 2, 3 and 4.

The assembled elements of FIG. 3 are suitably enclosed in a flexible moisture and vapor proof tubular casing 30, see FIG. 2, and an additional, generally U-shaped enclosure 31 may surround the sides and bottom of the casing 30 with its edges 32 secured to the door 12. Thus, the generally tubular inner casing 30 protectively encloses the herebefore described operative elements, and the outer enclosure 31 serves to mount the assembly to the door 12. The inner and outer casings 30 and 31 may also be fabricated of flexible plastic sheeting. In conventional manner, the conductive element 25 and 27 may be connected by leads, as at 32 and 33 in FIG. 4, for electrical connection to suitable control circuitry, such as a control relay for a motor, or other.

While safety edges in the past generally required substantial localized pressure to displace the normally spaced contacts into engagement, it was sometimes possible to engage the safety edge over a large extend of its length with a substantial total force and not close or engage the switch contacts. That is, the substantial total pressure against the switch is dispersed over a large area so as to be of insufficient unit pressure to effect the desired operation.

Figure 5:
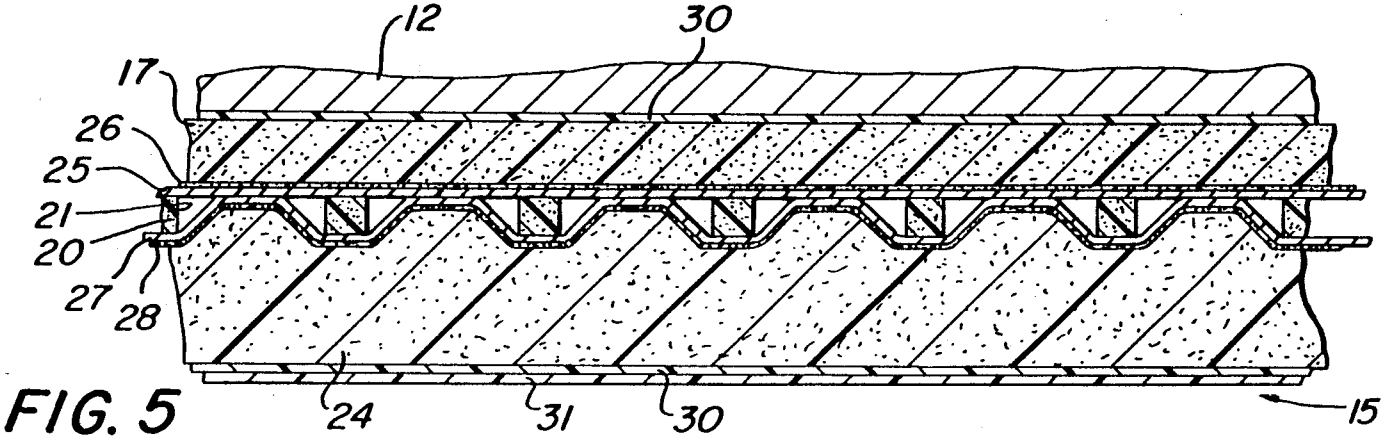
FIG. 5 is a longitudinal sectional view similar to FIG. 4, but illustrating the door edge switch in a pressurized, electrically contacting condition.

However, by the instant invention the resilient compressibility of the deflection element 24 and the spacer 20 are selected so that even under low unit pressure applied to the underside of the switch 15, the deflection element is elastically deformed into the perforations 21 of the spacer toward the inner element 17, so that the flexible conductive element, and particularly the element 27, is displaced into the perforations 21 for electrical connection between the conductive element. The condition is shown in FIG. 5. Switch operation may serve in many ways, for example, to deactivate an electric motor operating to close the door, as upon obstruction in the path of door movement, or upon completed door closure.

In practice, it has been found entirely satisfactory to employ a deflection element 24 having an elastic compressibility of about twice that of the spacer 20 to insure sensitivity under a wide range of conditions. Also, the size of the spacer perforations 21 are advantageously selected of a sufficiently small diameter for resilient protrusion of the deflection element 24 through the perforations without permanent deformation of the conductive elements 25 and 27 in contact with each other.

Figure 6:
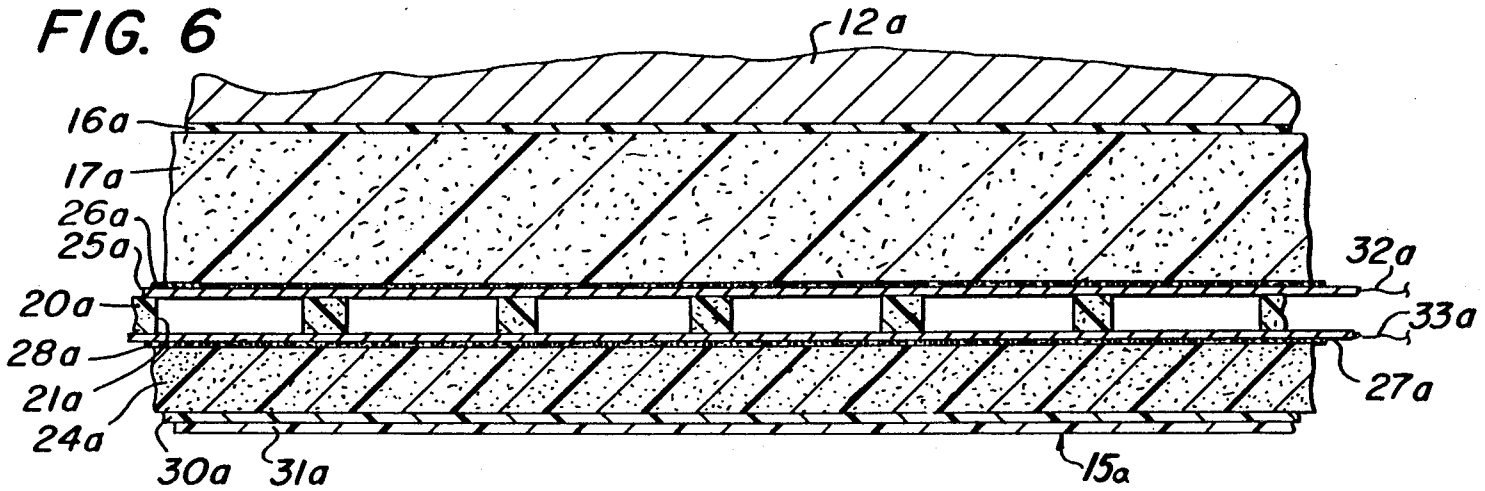
FIG. 6 is a longitudinal sectional view similar to FIG. 4, but showing a slightly modified embodiment wherein the more compressible and elastically deformable element is inward toward the door edge.
Figure 7:
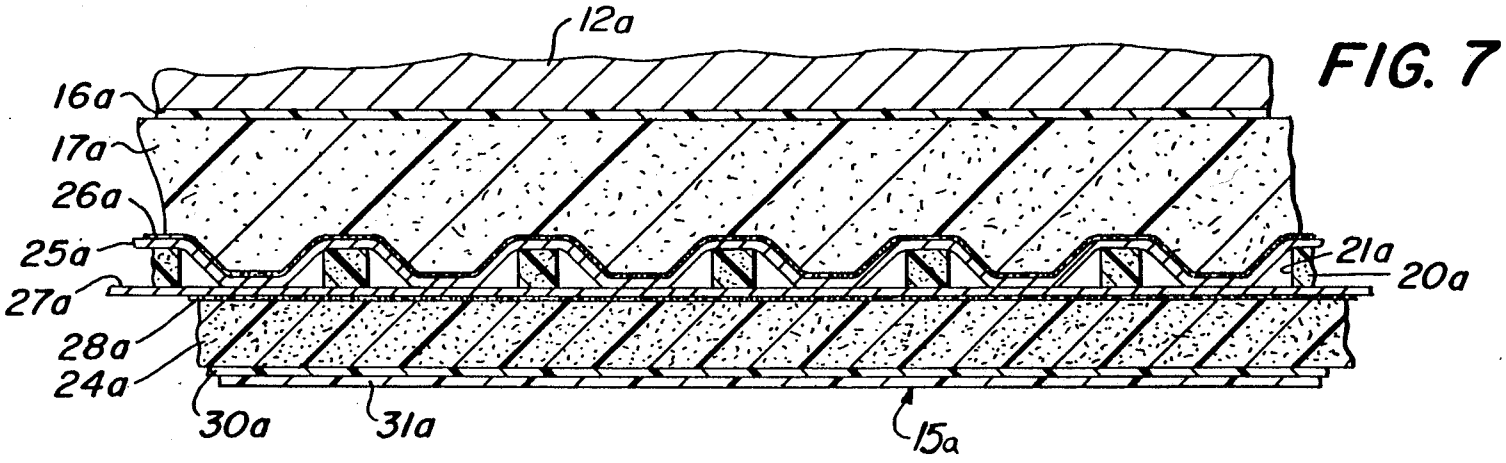
FIG. 7 is a longitudinal sectional view similar to FIG. 6, but illustrating the embodiment thereof in a pressurized, electrically contacting condition.

Referring now to the embodiment of FIGS. 6 and 7, the door is there generally designated **12*a*, and the high sensitivity door edge switch of the present invention is generally designated 15*a*. The door edge switch 15*a* may be essentially similar to the door edge switch 15, but the more compressible and elastically deformable switch element is located proximate to the door edge 16*a***, rather than remote from the door edge, as in the first described embodiment.

More particularly, an elongate inner foam element **17*a*, such as a strip of foam extends closely along and in facing relation with the leading door edge 16*a*** and may be relatively less dense so as to be characterized by relatively high compressibility and elastic deformability.

Immediately below and in facing relation with the inner element **17*a* is an intermediate spacer element or strip 20*a* which is of an openwork or perforated configuration having a series of through holes or perforations 21*a*. The spacer strip 20*a* may also be fabricated of plastic foam and may be of a hardness greater than that of the inner element 17*a***, as by being of greater density than the inner element.

Immediately beneath the spacer **20*a* is an outer elongate strip or element 24*a*, also advantageously fabricated of plastic foam. The inner element 17*a*, spacer 20*a* and outer element 24*a*** may all be of similar width and length so as to be substantially horizontally coextensive with each other.

The outer element **24*a*** is, in this embodiment, of relatively high density, so as to be relatively rigid, for enhanced durability of the assembly.

However, the resilient compressibility of the inner element **17*a* is sufficiently greater than that of the spacer 20*a* for resilient protrusion of the inner element through the perforations 21*a*** of the spacer under vertical compression of the assembly between horizontal planes.

Interposed between the spacer **20*a* and each of the inner element 17*a* and outer element 24*a* is a highly flexible and compliant electrically conductive element, as at 25*a* and 27*a*, respectively. The conductive elements may be of aluminum foil or other suitably flexible and conductive material, and may be reinforced by backing sheets, such as of plastic film, as at 26*a* and 28*a*. Thus, the conductive elements 25*a* and 27*a* are on opposite sides of the spacer 20*a* and in spaced confronting relation with each other through the perforations 21***a* in the at rest condition shown in FIG. 6.

As in the first described embodiment, the several foam layers are encased in a flexible moisture and vapor proof tubular casing 30*a* and an additional, generally U-shaped enclosure 31*a* having its edges secured to the door 12*a*. Also, the conductive elements 25*a* and 27*a* may be electrically connected, as by leads 32*a* and 33*a* for electrical connection to suitable control circuitry.

By this embodiment there is provided a stiffer, more durable outer element 24*a* for increased durability, as in certain industrial conditions where safety is not sacrificed for this improved durability. In contrast, the first described embodiment may be employed, as in elevators, mass transit doors, or the like where relatively soft outer elements are more safely presented to passing personnel. However, in both embodiments there is provided the enhanced sensitivity resulting from the relatively different compressibilities of the different layers.

From the foregoing, it is seen that the present invention provides a high sensitivity door edge switch which is relatively simple in construction and economical in manufacture, being capable of utilization in many widely varying condition, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A high sensitivity door edge switch used with a door having an edge for response to a low unit pressure applied over a large portion of the door edge, said door edge switch comprising, an inner element extending along the edge of said door having one face proximate the door edge, a resiliently compressible perforate spacer in facing relation with the other face of said inner element, said spacer including a plurality of spaced perforations extending generally perpendicular to said inner element, said spacer having a relatively greater elastic compressibility than said inner element, a substantially imperforate outer element in facing relation with said spacer remote from said inner element, said outer element having a relatively greater elastic compressibility than said spacer, said outer element being elastically deformable into the spacer perforations toward the inner element upon low unit pressure being applied over a large portion of the outer element and a pair of relatively flexible conductive elements located on opposite sides of said spacer and positioned respectively between the spacer and said inner and outer elements, said conductive elements being in spaced confronting relation through said spacer perforations in the absence of said low unit pressure and upon application of said low unit pressure to said outer element, at least one of said conductive elements deflecting into engagement with the other of said conductive elements by the elastic deformation of said outer element into all the spacer perforations encompassed by said large portion of the door edge.

2. A high sensitivity door edge switch according to claim 1, at least one of said conductive elements being of aluminum foil.

3. A high sensitivity door edge switch according to claim 1, wherein said inner and outer elements are constructed of foam.

4. A high sensitivity door edge switch according to claim 1, said outer element has an elastic compressibility of about twice that of said spacer to insure sensitivity under a wide range of conditions.

5. A high sensitivity door edge switch according to claim 1, wherein said inner and outer elements and said spacer are fabricated of foam.

6. A high sensitivity door edge switch according to claim 1, said perforate spacer having perforations sufficiently small for resilient protrusion of said outer element without permanent deformation of said conductive element into contact.

7. A high sensitivity door edge switch according to claim 1, said inner element, spacer and outer element all being substantially flat in undistended condition.

8. A high sensitivity door edge switch according to claim 1, the compressibility of said outer element being sufficiently greater than that of said spacer for resiliently protrusion of said outer element through the spacer to contact said conductive elements upon movement of the remote surfaces of said inner and outer elements in parallelism toward each other.

9. A high sensitivity door edge switch according to claim 1, said outer element and spacer being fabricated of foam, and the foam of said outer element having an elastic compressibility of at least 1.5 times that of the foam of said spacer.

10. A high sensitivity door edge switch used with a door having an edge for response to a low unit pressure applied over a large portion of the door edge, said door edge switch comprising, an inner element extending along the edge of said door, having one face proximate the door edge, a resiliently compressible perforate spacer in facing relation with the other face of said inner element, said spacer including a plurality of spaced perforations extending generally perpendicular to said inner element, said inner element having a relatively greater elastic compressibility than said spacer, a substantially imperforate outer element in facing relation with said spacer remote from said inner element, said spacer having a relatively greater elastic compressibility than said outer element, said inner element being elastically deformable into the spacer perforations toward the outer element upon low unit pressure being applied over a large portion of the outer element and a pair of relatively flexible conductive elements located on opposite sides of said spacer and positioned respectively between the spacer and said inner and outer elements, said conductive elements being in spaced confronting relation through said spacer perforations in the absence of said low unit pressure and upon application of said low unit pressure to said outer element, at least one of said conductive elements deflecting into engagement with the other of said conductive elements by the elastic deformation of said inner element into all the spacer perforations encompassed by the large portion of the door edge.

11. A high sensitivity door edge switch according to claim 10, the compressibility of said inner element being sufficiently greater than that of said spacer for resilient protrusion of said inner element through the spacer to contact conductive elements upon movement of the remote surfaces of said inner and outer element in parallelism toward each other.

12. A high sensitivity door edge switch according to claim 10, said inner element and spacer being fabricated of foam, and the foam of said inner element having an elastic compressibility of at least 1.5 times that of the foam of said spacer.

* * * * *